US007632145B1

(12) United States Patent
Lin et al.

(10) Patent No.: US 7,632,145 B1
(45) Date of Patent: Dec. 15, 2009

(54) RECEPTACLE CONNECTOR

(75) Inventors: Sheng-Chan Lin, HsinTien (TW); Pin-Yuan Hou, HsinTien (TW); Wen-Hsien Tsai, HsinTien (TW)

(73) Assignee: Advanced-Connectek Inc., Taipei County (TW)

( * ) Notice: Subject to any disclaimer, the term of this patent is extended or adjusted under 35 U.S.C. 154(b) by 0 days.

(21) Appl. No.: 12/359,447

(22) Filed: Jan. 26, 2009

(51) Int. Cl.
*H01R 13/648* (2006.01)

(52) U.S. Cl. ..... 439/607.32

(58) Field of Classification Search ..... 439/607.07, 439/83, 557, 76.1, 79–80, 752
See application file for complete search history.

(56) References Cited

U.S. PATENT DOCUMENTS 5,928,035 A * 7/1999 Jankowsky et al. ..... 439/607.36
6,319,051 B1 * 11/2001 Chang et al. ..... 439/490
6,361,373 B1 * 3/2002 Horchler ..... 439/701
6,464,523 B1 * 10/2002 LeVine ..... 439/271
6,547,591 B2 * 4/2003 Okabe et al. ..... 439/557

* cited by examiner

*Primary Examiner*—Jean F Duverne
(74) *Attorney, Agent, or Firm*—Rabin & Berdo, P.C.

(57) ABSTRACT

A receptacle connector comprises an inner housing, multiple first pins, multiple second pins, an outer housing, an inner casing and an outer casing. The first pins and the second pins are mounted through the inner housing. The outer housing is mounted around the inner casing. The outer casing is a folded sheet of metal and is mounted around the outer housing.

4 Claims, 5 Drawing Sheets

RECEPTACLE CONNECTOR

FIELD OF THE INVENTION

The invention is a receptacle connector, and more particularly, a receptacle connector less susceptible to electromagnetic interference (EMI) and capable of handling higher transmission frequency, and complies with Mini Display Port specification.

BACKGROUND OF THE INVENTION

A Display Port is a standard interface in digital audio and video signal transmission with high frequency transmission rate of 10.8 Gb/s. A computer connects to an LCD, plasma or CRT monitor or a projector through the Display Port to improves color saturation, resolution and refresh rate of a monitor. The transmission quality of the Display Port may be unstable at high frequency.

Recently, a Mini Display Port provides functions of a Display Port but is smaller replaces conventional Display Ports. With reference to FIG. 1, a conventional Mini Display Port (2) comprises at least one terminal (21), a first casing (22), a second casing (23) and a third casing (24). The first casing (22) has a ground element (221). The second casing (23) connects to the first casing (22) by welding. The third casing (24) electrically connects to the second casing (23) by a flexible unit or spot welds (231). The three casings (22, 23, 24) may not connect perfectly to each other or an external force may reduce the transmission efficiency at high frequency.

SUMMARY OF THE INVENTION

The main objective of the present invention is to provide a receptacle connector with a high frequency transmission rate, which reduces electromagnetic interference (EMI), lowers production cost and improves structural strength.

A receptacle connector in accordance with the present invention comprises an inner housing, multiple first pins, multiple second pins, an outer housing, an inner casing and an outer casing. The first pins and the second pins are mounted through the inner housing. The outer housing is mounted around the inner casing. The outer casing is a folded sheet of metal and is mounted around the outer housing.

DESCRIPTION OF THE PREFERRED EMBODIMENT

Figure 1:
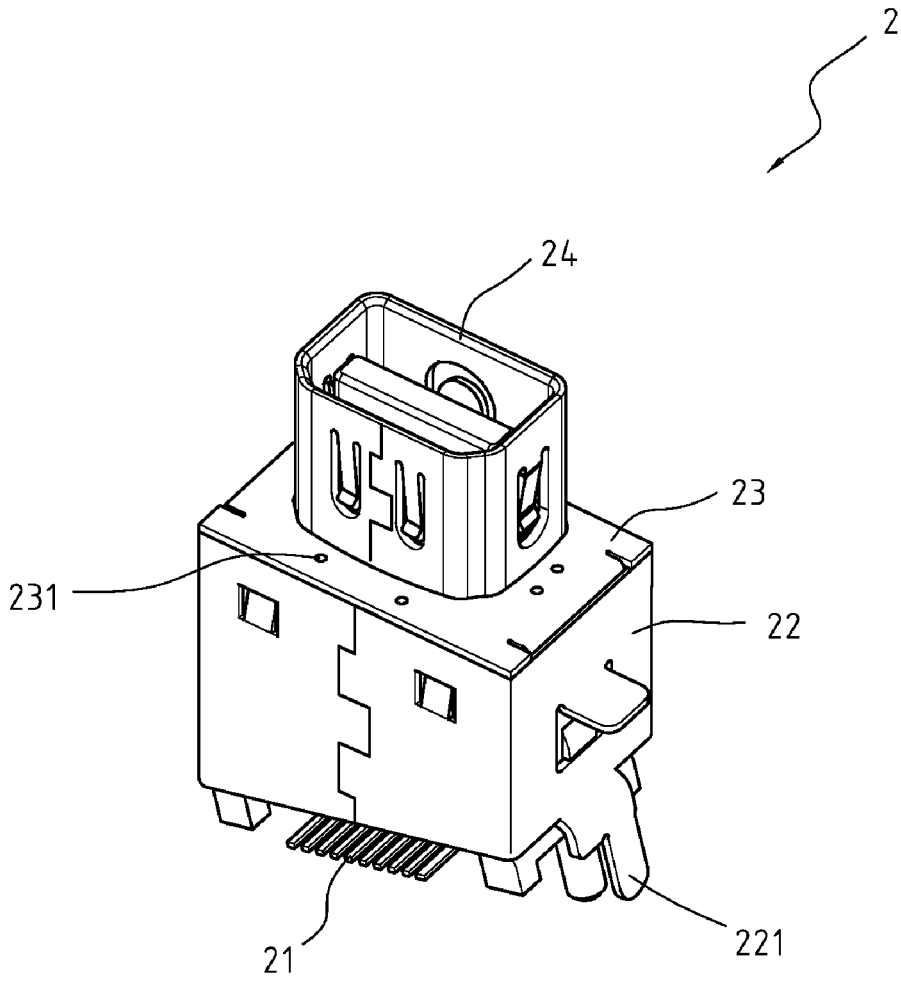
Fig. 1 PRIOR ART
FIG. 1 is a perspective view of a conventional receptacle connector.
Figure 2:
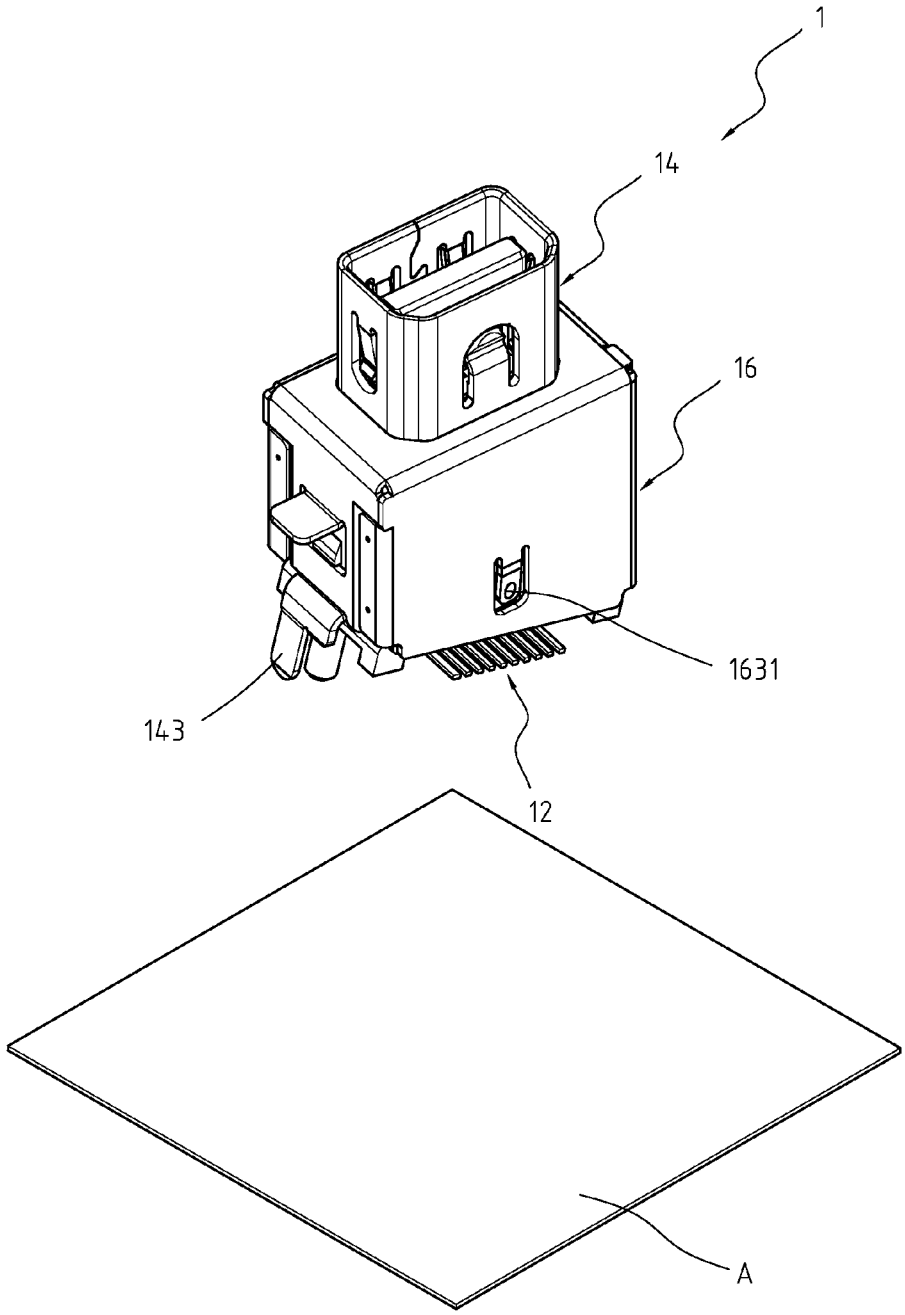
FIG. 2 is a perspective view of a receptacle connector in accordance with the present invention.
Figure 3:
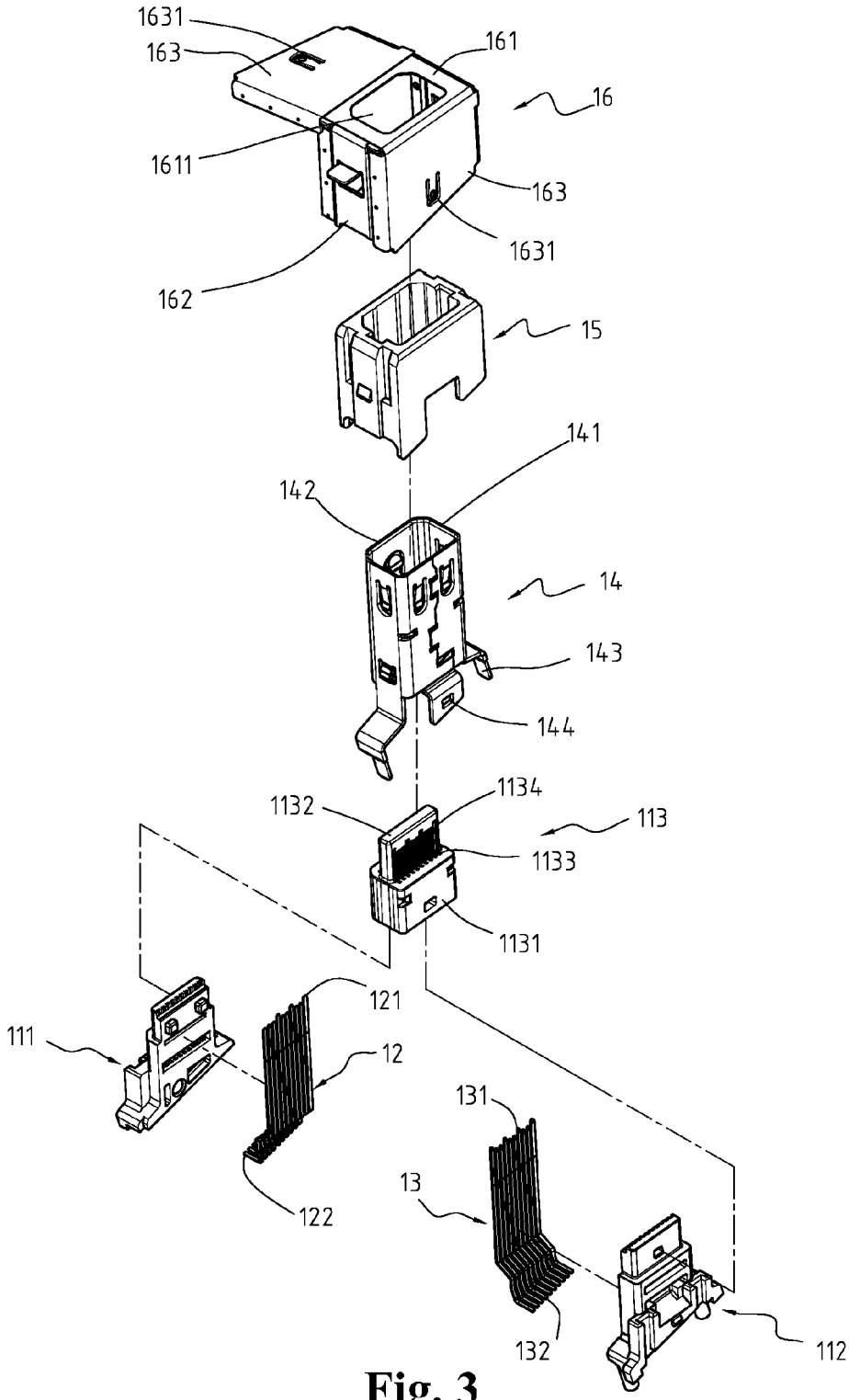
FIG. 3 is an exploded perspective view of a receptacle connector in FIG. 2.
Figure 4:
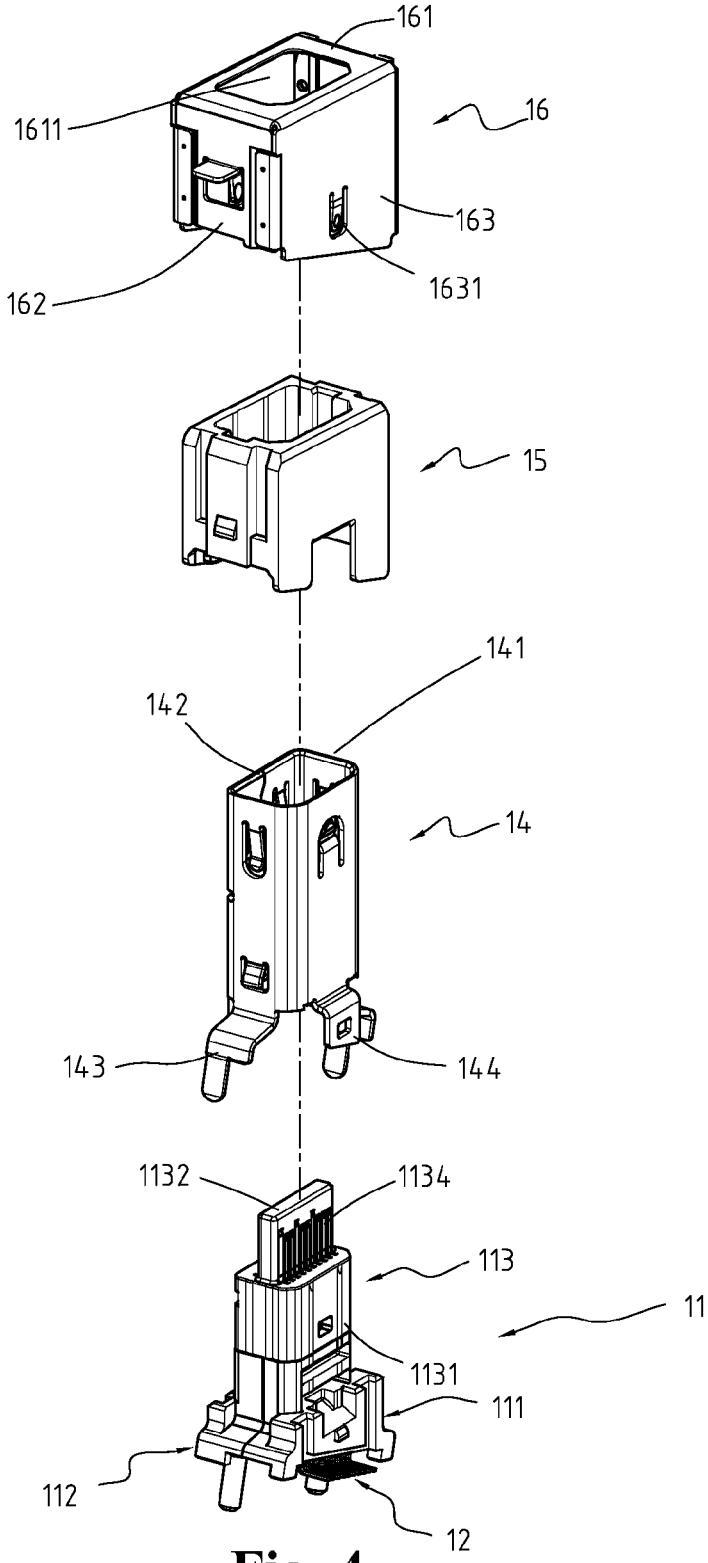
FIG. 4 is a partially exploded perspective view of a receptacle connector in FIG. 2.
Figure 5:
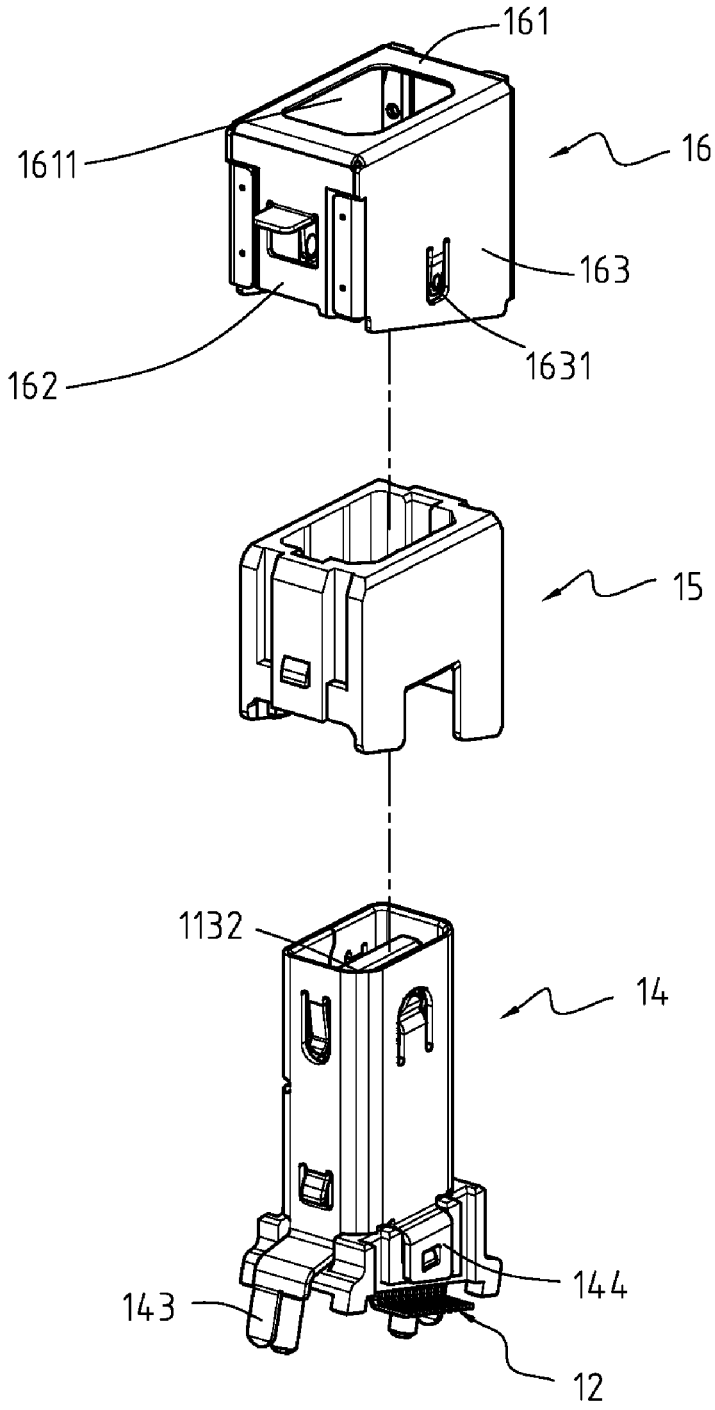
FIG. 5 is a partially exploded perspective view of a receptacle connector in FIG. 2.

With reference to FIGS. 2 to 5, a receptacle connector (1) is a digital audio/video interface, is mounted on a printed circuit board (PCB) (A), protrudes through an electronic device casing and comprises an inner housing (11), 10 first pins (12), 10 second pins (13), an inner casing (14), an outer housing (15) and an outer casing (16).

The inner housing (11) is insulation, has an inner end and an outer end and comprises an inner first pin holder (111), an inner second pin holder (112) and an outer pin holder (113).

The inner first pin holder (111) has an inner end, an outer end, a base, a tongue and multiple pin passages. The base is formed at the inner end. The tongue connects the base to the outer end. The pin passages are formed through the inner first pin holder (111) from the inner end to the outer end.

The inner second pin holder (112) is complementary and connects to the inner first pin holder (111) and has an inner end, an outer end, a base, a tongue and multiple pin passages. The base is formed at the inner end. The tongue connects the base to the outer end. The pin passages are formed through the inner second pin holder (112) from the inner end to the outer end.

The outer pin holder (113) is mounted on and protrudes from the outer ends of the inner first pin holder (111) and the inner second pin holder (112) and comprises a main body (1131) and an extension (1132).

The main body (1131) connects to the inner first pin holder (111) and the inner second pin holder (112) and has an inner end, an outer end, an inner mounting recess and multiple pin passages (11311). The inner mounting recess is formed in the inner end and corresponds to and is mounted on the complementary tongues of the inner first pin holder (111) and the inner second pin holder (112). The pin passages (11311) correspond to and align with the pin passages in the inner first pin holder (111) and the inner second pin holder (112).

The extension (1132) is formed on and protrudes longitudinally from the outer end of the main body (1131) and has multiple pin grooves (11321). The pin grooves (11321) correspond respectively to and align respectively with the pin passages (11311) in the main body (1131).

The first pins (12) are insert-molded in and protrude from the inner first pin holder (111) in the inner housing (11), the pin passages (11311) in the main body (1131) of the outer pin holder (113) and the pin grooves (11321) in the extension (1132), and each first pin (12) has a first end (121) and a second end (122).

The second pins (13) are insert-molded and protrude from the inner second pin holder (112) in the inner housing (11), the pin passages (11311) in the main body (1131) of the outer pin holder (113) and the pin grooves (11321) in the extension (1132), and each second pin (13) has a first end (131) and a second end (132). The second ends (122, 132) correspond respectively to the first ends (121, 131) and electrically connect to a printed circuit board (A).

The inner casing (14) is metal, is mounted around the inner housing (11), connects to a PCB (A), has an open top and an open bottom and comprises two narrow sides (141), two wide sides (142), two ground connectors (143) and two electrical contacts (144).

The narrow sides (141) are formed opposite to each other, and each narrow side (141) has an upper end, a lower end and two side edges. The upper end corresponds to the open top. The lower end corresponds to the open bottom. The side edges on each narrow side (141) are formed opposite to each other.

The wide sides (142) are formed opposite to each other between side edges of opposite narrow sides (141) to form an elongated rectangular tube, and each wide side (142) has an upper end and a lower end. The upper end corresponds to the open top. The lower end corresponds to the open bottom.

The ground connectors (143) are formed respectively on the lower ends of the narrow sides (141), protrude down and connect respectively to ground connectors on the PCB (A) to transmit electromagnetic waves away from the receptacle connector (1) and reduce EMI.

The electrical contacts (144) are formed respectively on the lower ends of the wide sides (142) and protrude down so any electricity going to the electrical contacts (144) is shunted to ground through the ground connectors (143) and the PCB (A).

The outer housing (15) is insulation, is hollow, is mounted around the inner casing (14) and has an open top and an open bottom.

The outer casing (16) is a folded sheet of metal, is mounted around the outer housing (15) and comprises a top surface (161), two narrow sides (162) and two wide sides (163).

The top surface (161) has a central through-hole (1611), two narrow edges and two wide edges. The central through-hole (1611) corresponds to and aligns with the open top of the outer housing (15).

The narrow sides (162) are formed respectively on and protrude down respectively from the narrow edges, and each narrow side (162) has two recessed side edges. The recessed side edges are parallel and opposite to each other.

The wide sides (163) are formed respectively on and protrude down respectively from the wide edges, and each wide side (163) has two side edges, two locking lips and a flexible contact (1631). The locking lips are formed respectively on the side edges and connect respectively to recessed side edges on opposite narrow sides (162). The flexible contacts (1631) connect respectively to the electrical contacts (144) of the inner casing (14) to transmit electromagnetic waves from the outer casing (16) to the inner casing (14).

What is claimed is:

1. A receptacle connector being mounted on a printed circuit board (PCB), protruding through an electronic device casing and comprising an inner housing being insulation, having an inner end and an outer end and comprising an inner first pin holder having an inner end;

an outer end;

a base being formed at the inner end;

a tongue connecting the base to the outer end; and multiple pin passages being formed through the inner first pin holder from the inner end to the outer end;

an inner second pin holder being complementary and connecting to the inner first pin holder and having an inner end;

an outer end;

a base being formed at the inner end;

a tongue connecting the base to the outer end; and multiple pin passages being formed through the inner second pin holder from the inner end to the outer end; and an outer pin holder being mounted on and protruding from the outer ends of the inner first pin holder and the inner second pin holder and comprises a main body connecting to the inner first pin holder and the inner second pin holder and having an inner end;

an outer end;

an inner mounting recess being formed in the inner end and corresponding to and being mounted on the complementary tongues of the inner first pin holder and the inner second pin holder; and multiple pin passages corresponding to and aligning with the pin passages in the inner first pin holder and the inner second pin holder; and an extension being formed on and protruding longitudinally from the outer end of the main body and having multiple pin grooves corresponding respectively to and aligning respectively with the pin passages in the main body;

multiple first pins being mounted in and protruding from the inner first pin holder in the inner housing, the pin passages in the main body of the outer pin holder and the pin grooves in the extension, and each first pin having a first end; and a second end corresponding respectively to the first ends and electrically connecting to a PCB;

multiple second pins, being mounted in and protruding from the inner second pin holder in the inner housing, the pin passages in the main body of the outer pin holder and the pin grooves in the extension, and each second pin having a first end and a second end; and an inner casing being metal, being mounted around the inner housing, connecting to a PCB, having an open top and an open bottom and comprising two narrow sides being formed opposite to each other, and each narrow side having an upper end corresponding to the open top;

a lower end corresponding to the open bottom; and two side edges being formed opposite to each other two wide sides being formed opposite to each other between side edges of opposite narrow sides to form an elongated rectangular tube, and each wide side having an upper end corresponding to the open top; and a lower end corresponding to the open bottom;

two ground connectors being formed respectively on the lower ends of the narrow sides, protruding down and connecting respectively to ground connectors on the PCB to transmit electromagnetic waves away from the receptacle connector and reduce EMI; and two electrical contacts being formed respectively on the lower ends of the wide sides and protruding down so any electricity going to the electrical contacts is shunted to ground through the ground connectors and the PCB;

an outer housing being insulation, being hollow, being mounted around the inner casing and having an open top and an open bottom; and an outer casing being a folded sheet of metal, being mounted around the outer housing and comprising a top surface having a central through-hole corresponding to and aligning with the open top of the outer housing;

two narrow edges; and two wide edges;

two narrow sides being formed respectively on and protruding down respectively from the narrow edges, and each narrow side having two recessed side edges being parallel and opposite to each other; and two wide sides being formed respectively on and protruding down respectively from the wide edges, and each wide side having two side edges;

two locking lips being formed respectively on the side edges and connecting respectively to recessed side edges on opposite narrow sides; and a flexible contact connecting respectively to the electrical contacts of the inner casing to transmit electromagnetic waves from the outer casing to the inner casing.

2. The receptacle connector as claimed as claim 1, wherein the receptacle connector complying with a Mini Display Port specification.

3. The receptacle connector as claimed as claim 1, wherein the first pin being insert-molded in the inner housing.

4. The receptacle connector as claimed as claim 1, wherein the second pin being insert-molded in the inner housing.

* * * * *